US006237177B1

(12) United States Patent
Richardson

(10) Patent No.: US 6,237,177 B1
(45) Date of Patent: May 29, 2001

(54) VEHICULAR STORM DRAIN CLEANING APPARATUS

(76) Inventor: David Richardson, 48 Valencia Dr., Dunedin, FL (US) 34698

( * ) Notice: Subject to any disclaimer, the term of this patent is extended or adjusted under 35 U.S.C. 154(b) by 0 days.

(21) Appl. No.: 09/332,523

(22) Filed: Jun. 14, 1999

(51) Int. Cl.[7] ..... B08B 9/049

(52) U.S. Cl. ..... 15/4; 15/83; 15/93.1; 15/104.31; 15/104.09; 15/52.1

(58) Field of Search ..... 15/1.7, 3, 4, 49.1, 15/78, 82, 83, 93.1, 104.31, 104.09, 104.12, 104.05, 340.1, 340.3, 52.1

(56) References Cited

U.S. PATENT DOCUMENTS

| | | | | |
|---|---|---|---|---|
| 356,754 | * | 2/1887 | Duffy | 15/104.31 |
| 362,153 | * | 5/1887 | Fitzgerald | 15/104.31 |
| 3,189,932 | * | 6/1965 | Daneman | 15/340.3 |
| 3,800,358 | * | 4/1974 | Ryan | 15/104.05 |
| 4,938,167 | * | 7/1990 | Mizuho et al. | 15/104.31 |
| 5,185,899 | * | 2/1993 | Urbani | 15/93.1 |
| 5,335,395 | * | 8/1994 | Allen | 15/93.1 |
| 5,377,381 | * | 1/1995 | Wilson | 15/104.09 |
| 5,416,944 | * | 5/1995 | Eriksson | 15/104.09 |
| 5,687,443 | * | 11/1997 | Moore | 15/49.1 |
| 5,893,189 | * | 4/1999 | D'Costa | 15/83 |

* cited by examiner

*Primary Examiner*—Robert J. Warden, Sr.
*Assistant Examiner*—Theresa T. Snider

(57) ABSTRACT

The apparatus includes a water tight vehicular body of a low profile. A user controls the vehicle from a forward cockpit. The cleaning apparatus further includes both forward and rearward booms. The forward boom has a slurry trap interconnected to its forward extent. Additionally, a brush is secured to the rearward boom. Both the booms can be elevated and lowered to selectively bring the trap and brush into contact with the ground. Thus, the cleaning apparatus is adapted to be driven into the interior of a drain pipe. Thereafter, the booms are lowered such that the trap and bush come into contact with the surface to be cleaned. The vehicle can then be driven rearwardly. During the rearward travel, the brush serves to agitate floor contaminates into a slurry. Further rearward travel causes the slurry to become contained within the trap. Through this method, floor contaminates can be removed from an enclosed region such as a storm drain.

2 Claims, 5 Drawing Sheets

FIG 2
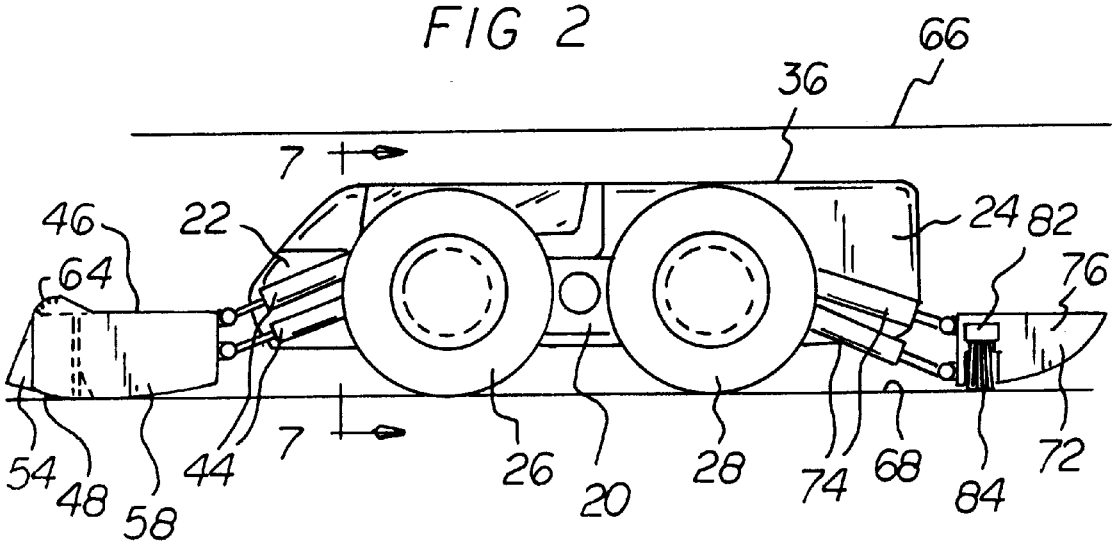
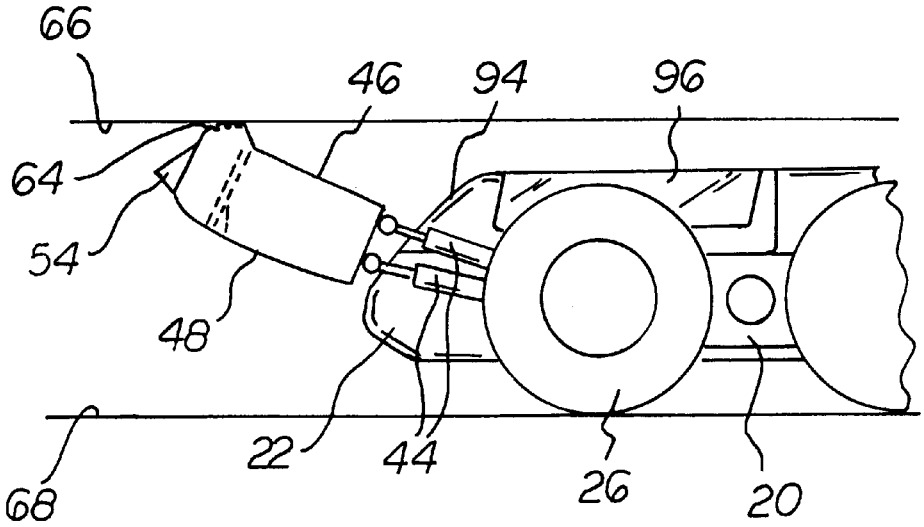
FIG 3

FIG 9
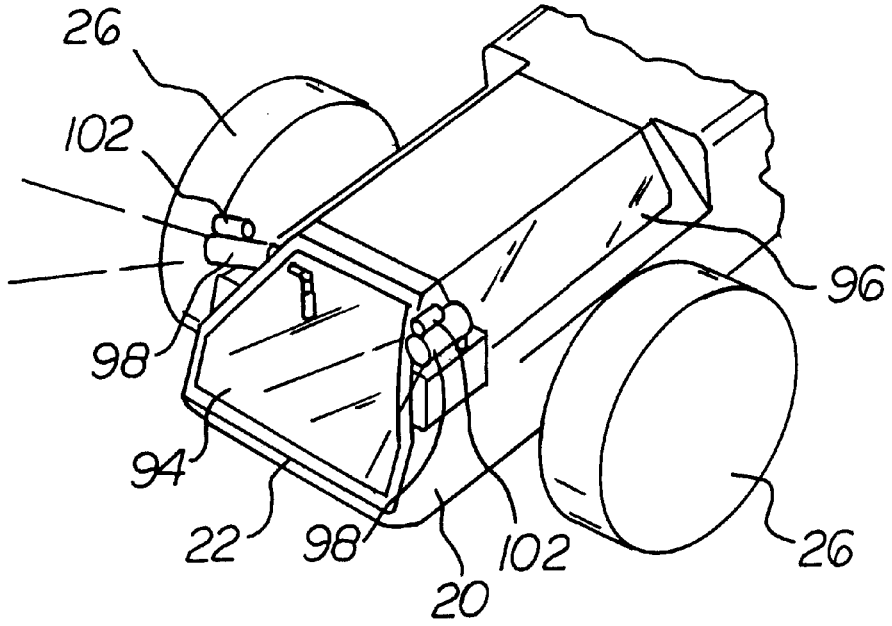
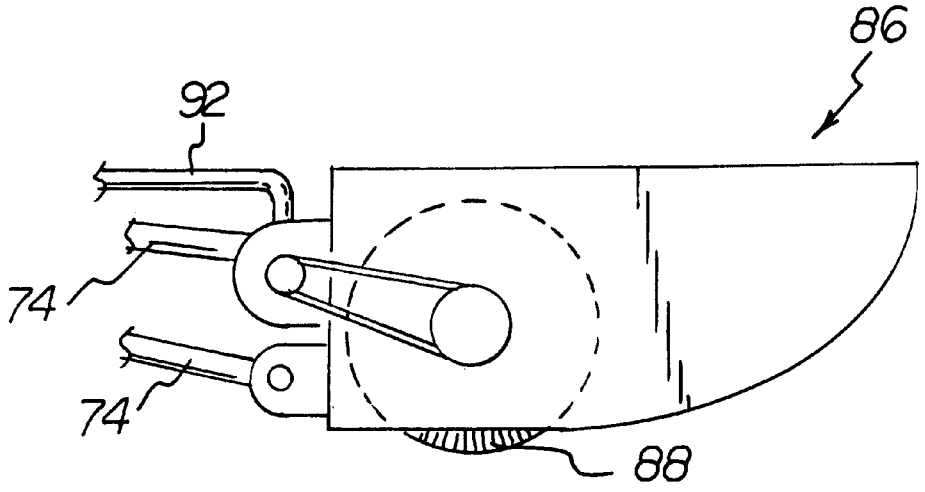
FIG 10

VEHICULAR STORM DRAIN CLEANING APPARATUS

BACKGROUND OF THE INVENTION

1. Field of the Invention

The present invention relates to a new and improved storm drain cleaning apparatus and, more particularly, pertains to an operator driven vehicle with a forward slurry trap and rearward brush.

2. Description of the Prior Art

The use of mobile cleaning devices is known in the prior art. More specifically, mobile cleaning devices heretofore devised and utilized for the purpose of scrubbing surfaces are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,207,647 discloses a mobile sewer cleaning and vacuum unit. Additionally, U.S. Pat. No. 4,567,514 discloses a camera carrying conduit inspection sled. Finally, U.S. Pat. No. 4,194,218 discloses an inspection apparatus for underground channels.

In this respect, the cleaning apparatus according to the present invention substantially departs from the conventional concepts and designs of the prior art, and in doing so provides an apparatus primarily developed for the purpose of gaining access to underground storm drains and culverts so that they can be effectively cleaned.

Therefore, it can be appreciated that there exists a continuing need for new and improved storm drain cleaning devices which can be used to more efficiently and effectively clean underground drainage pipes. In this regard, the present invention substantially fulfills this need.

SUMMARY OF THE INVENTION

In view of the foregoing disadvantages inherent in the known types of cleaning devices now present in the prior art, the present invention provides an apparatus which can be driven into underground drainage pipes and culverts for the purposes of cleaning them.

To attain this, the present invention essentially comprises a low profile tractor. The tractor is defined by a low profile watertight body having a front end and a rear end. A diesel motor is positioned within the rearward extent. Four axle motors are positioned upon the two axles for use in driving four wheels. Energy transfer means are also included for transferring power from the diesel motor to the individual axle motors. A front trap is mounted on the front end of the device by way of hydraulic booms. The trap is defined by four sides, an upper peripheral edge and a lower peripheral edge. The upper peripheral edge of either side of the front trap includes a series of teeth, with the teeth functioning to apply pressure to the top of a drainage pipe. Such pressure functions in allowing the tractor to wedge itself out of tight situations. The lower peripheral edge is rounded and angled approximate its inner portion. A front blade extends across the interior of the trap. The trap, by way of the hydraulic booms, is adapted to be lifted up and folded back on top of the body of the tractor. A rear brush is mounted to the rear extent of the tractor by way of hydraulic booms. The rear brush includes two sides which are angled as well as a central stock. The stock is used in supporting a plurality of bristles which extend downwardly below the lower peripheral extent of the sides.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide an apparatus which is specifically designed to clean underground drainage pipes and culverts.

It is another object of the present invention to provide a cleaning apparatus which can be driven and maneuvered by a single occupant.

It is a further object of the present invention to provide a cleaning apparatus which is defined by a low profile, to thereby allow the cleaning apparatus to be driven into narrow spaces.

An even further object of the present invention is to establish a method whereby floor contaminates can be brushed up into a slurry and subsequently contained within a sediment trap.

Even still another object of the present invention is to provide an apparatus which can effectively carry out the aforementioned method.

Lastly, it is an object of the present invention to provide an apparatus which includes a water tight vehicular body of a low profile. A user controls the vehicle from a forward cockpit. The cleaning apparatus further includes both forward and rearward booms. The forward boom has a slurry trap interconnected to its forward extent. Additionally, a brush is secured to the rearward boom. Both the booms can be elevated and lowered to selectively bring the trap and brush into contact with the ground. Thus, the cleaning apparatus is adapted to be driven into the interior of a drain pipe. Thereafter, the booms are lowered such that the trap and bush come into contact with the surface to be cleaned. The vehicle can then be driven rearwardly. During the rearward travel, the brush serves to agitate floor contaminates into a slurry. Further rearward travel causes the slurry to become contained within the trap. Through this method, floor contaminates can be removed from an enclosed region such as a storm drain.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is side elevational view of the vehicular storm drain cleaning apparatus.

FIG. 3 is a side elevational view of the vehicular storm drain cleaning apparatus with the front boom elevated.

FIG. 9 is a perspective view of the forward portion of the vehicular storm drain cleaning apparatus.

FIG. 10 is a view of the rear rotary brush employed in conjunction with the cleaning apparatus.

The same reference numerals refer to the same parts throughout the various Figures.

DESCRIPTION OF THE PREFERRED EMBODIMENT

Figure 1:
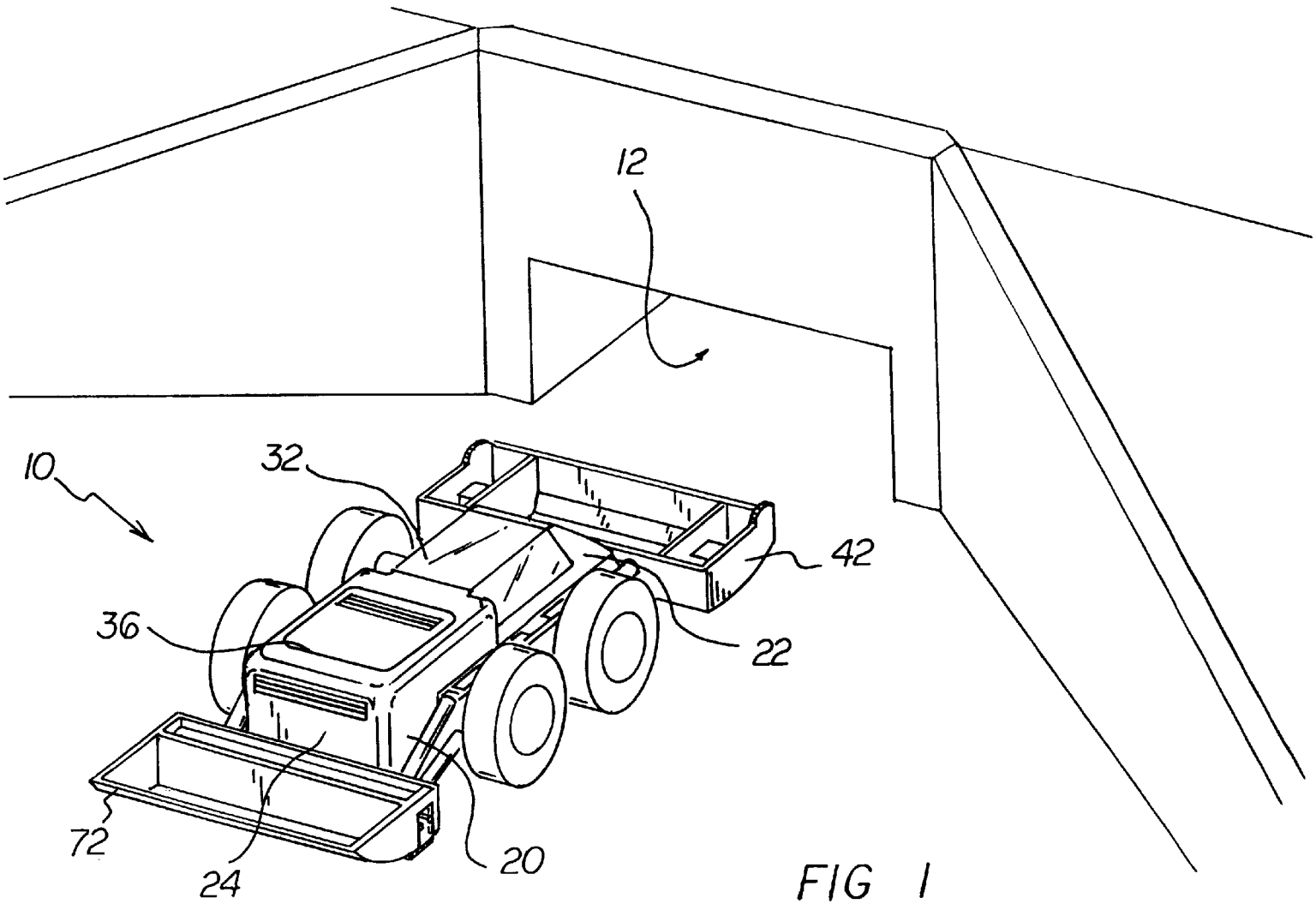
FIG. 1 is a perspective illustration of the preferred embodiment of the vehicular storm drain cleaning apparatus constructed in accordance with the principles of the present invention.

With reference now to the drawings, the preferred embodiment of the new and improved vehicular storm drain cleaning apparatus embodying the principles and concepts of the present invention, and generally designated by the reference numeral 10, will be described.

The apparatus includes a water tight vehicular body of a low profile. A user controls the vehicle from a forward cockpit. The cleaning apparatus further includes both forward and rearward booms. The forward boom has a slurry trap interconnected to its forward extent. Additionally, a brush is secured to the rearward boom. Both the booms can be elevated and lowered to selectively bring the trap and brush into contact with the ground. The cleaning apparatus is adapted to be driven into the interior of a drain pipe or culvert. Thereafter, in accordance with the method of the present invention, the booms are lowered such that the trap and brush come into contact with the surface to be cleaned. The vehicle can then be driven rearwardly. During the rearward travel, the brush serves to agitate floor contaminates into a slurry. Further rearward travel causes the slurry to become contained within the trap. Through this method, floor contaminates can be removed from an enclosed region such as a storm drain. The details of the various components of the cleaning apparatus, and the manner in which they interrelate, will be described in greater detail hereinafter.

The Vehicular Cleaning Apparatus

Figure 7:
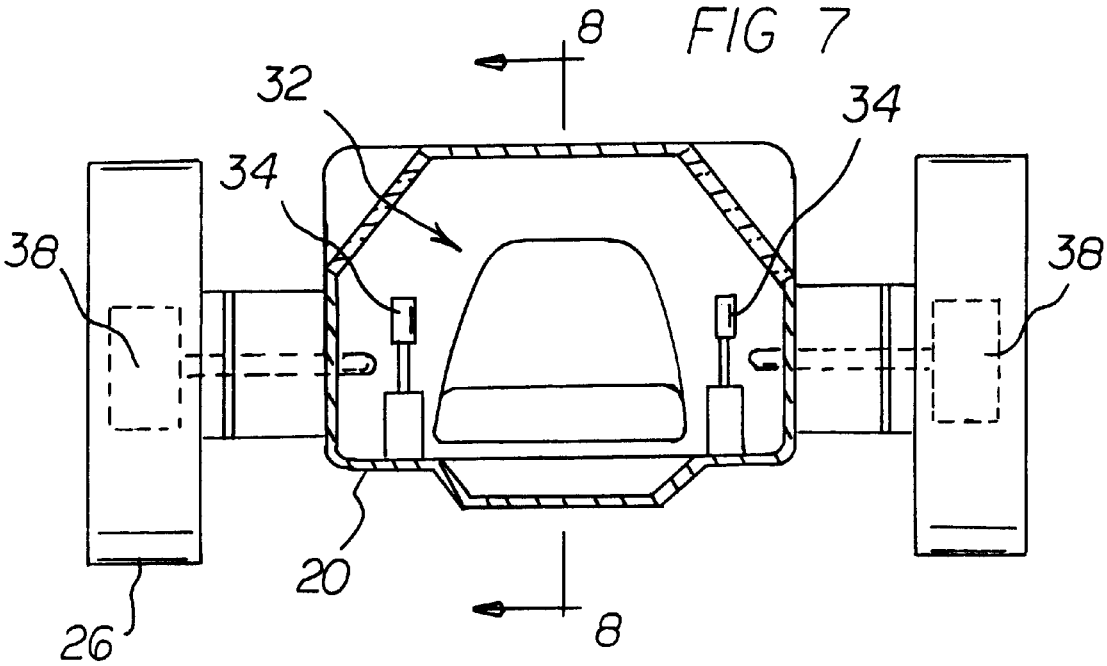
FIG. 7 is a sectional view taken along line 7—7 of FIG. 2.
Figure 8:
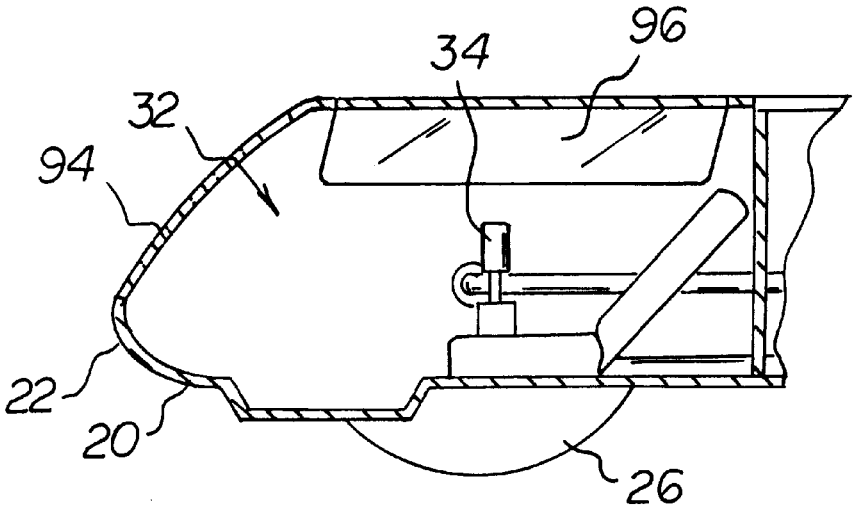
FIG. 8 is a sectional view taken along line 8—8 of FIG. 7.

FIG. 1 illustrates a vehicular cleaning apparatus 10 entering into a draining pipe 12 to be cleaned. The cleaning apparatus 10 takes the form of a low profile tractor. The tractor is defined by a body 20 having a front end 22 and a rear end 24. Furthermore, the vehicle includes four wheels—two 26 positioned at the forward potion 22 and two 28 positioned at the rearward portion 24. As illustrated in FIG. 2, preferably the height of the wheels 26 and 28 is approximate to the height of the vehicle body 20. This height relationship allows for maximum traction and control, yet also permits entry of the vehicle into low profile areas. A cockpit 32 is positioned within the front end 22 of the body 20 and is dimensioned to accommodate a user and various vehicle controls. FIGS. 7 and 8 illustrate some of the controls which can be employed. Specifically, the preferred embodiment contemplates control by two levers 34. Forward and rearward movement, as well as right and left rotation, can all be achieved through use of the two levers 34. These movements are achieved through a differential drive. Namely, the vehicle is not articulated. Rather, right and left movement is accomplished through increased or decreased rotational movement of the respective wheels.

In the preferred embodiment, the body 20 is completely water tight. The water tight nature of the body 20 can be achieved by any number of ways known in the art. The enclosed areas into which the cleaning apparatus is designed to be driven are often filled with water and/or sludge. Thus, the vehicle body 20 needs to be fluid tight to preclude fluids from entering into the cockpit 32 or the engine compartment 36.

The engine compartment 36 of the vehicle is illustrated in FIG. 1. In one embodiment, a diesel motor is positioned within the engine compartment 36 of the rearward extent. The engine compartment 36 can also house a source of pressurized hydraulic fluid. The hydraulic fluid serves to power various implements associated with the vehicle in a manner to be described more fully hereinafter. Additionally, the vehicle includes energy transfer means for transferring power from the motor to each of the individual axles in a manner known in the art. In an additional embodiment, the central motor is replaced by four individual axle motors 38. Each of these individual motors 38, note FIG. 7, are positioned upon the axles. Through the four axle motors 38 the four wheels can be independently driven in either a forward or rearward rotation. Additionally, in conjunction with the four axle motors, energy transfer means are included for transferring power from a central location, such as a diesel motor.

Figure 4:
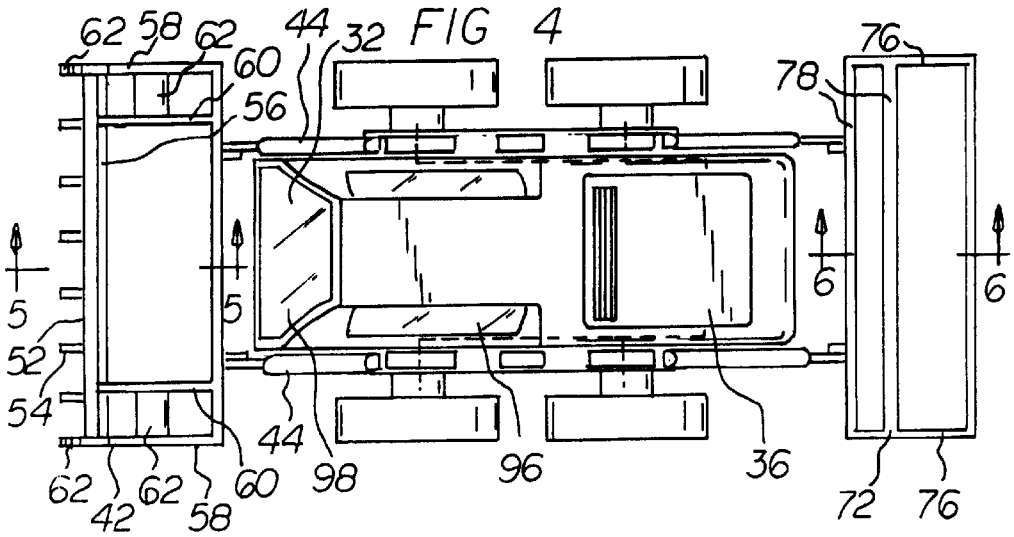
FIG. 4 is a plan view of the vehicular storm drain cleaning apparatus.

Turning now to FIG. 4, the front trap 42 is depicted. This front trap 42 is preferably mounted on the front end 22 of the cleaning apparatus 10 by way of hydraulic booms 44. These booms 44 enable the trap 42 to be selectively elevated and lowered. A number of hydraulic lines are provided to deliver hydraulic fluid to, and power, the individual booms 44. In total, a set of four hydraulic booms 44 are employed in order to effect the raising, lowering and rotation of the trap 42. Furthermore, by way of the hydraulic booms 44 the trap 42 is adapted to be lifted up and folded back on top of the body 20 of the tractor. This helps give the entire apparatus 10 a compact profile for storage and transport. With continuing reference to FIG. 4, the four sides of the trap 42 are illustrated. Additionally, FIGS. 2 and 3 illustrate the upper and lower peripheral edges of the trap, 46 and 48 respectively. The forward edge 52 of the trap 42 includes a series of triangular teeth 54 which are employed in dislodging contaminates from a surface to be cleaned. Immediately adjacent the forward edge 52 is a reinforcing surface 56, or front blade, which spans the interior width of the trap 42. The two side edges 58 also include reinforcing surfaces 60.

The region between either side edge 58 and its corresponding reinforcing surface 60 includes a spanning element 62.

Figure 5:
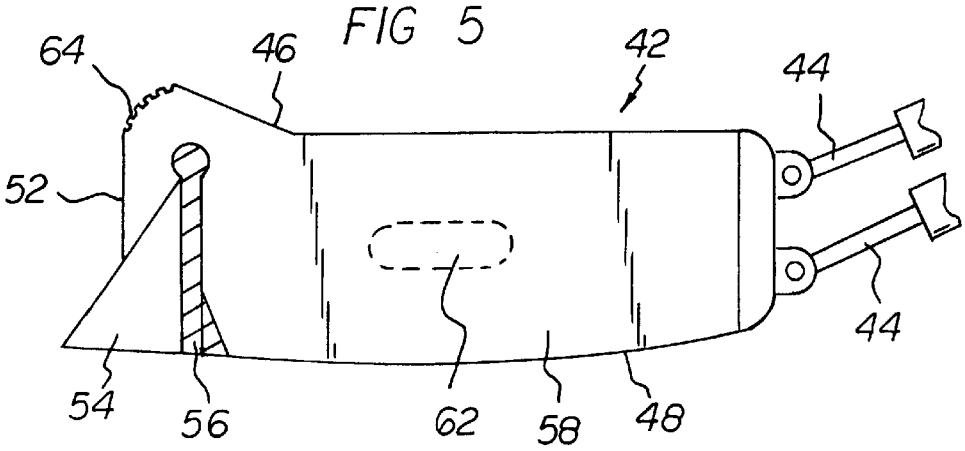
FIG. 5 is a sectional view taken along line 5—5 of FIG. 4.

FIG. 5 illustrates the toothed segment 64 which is present on either side of the trap 42. More specifically, the upper peripheral edge 46 of either side defines a series of teeth 64. These teeth 64 function in applying pressure to the top of a drainage pipe. When the cleaning apparatus is operated in a low profile environment, such as a drainage pipe, it can become stuck, or otherwise wedged, between the upper and lower surfaces 66 and 68 of the enclosure. In such situations, the forward boom 44 can be elevated in order to engage the teeth 64 with the upper surface 66. This engagement, coupled with the rearward movement of the vehicle, can operate to wedge the tractor out of such tight situations.

FIG. 5 also illustrates the lower peripheral edge 48 of the trap 42. The lower peripheral edge 48 is preferably rounded and angled approximate its inner portion. This lower edge 48 geometry enables the trap 42 to smoothly travel over uneven pavement.

Figure 6:
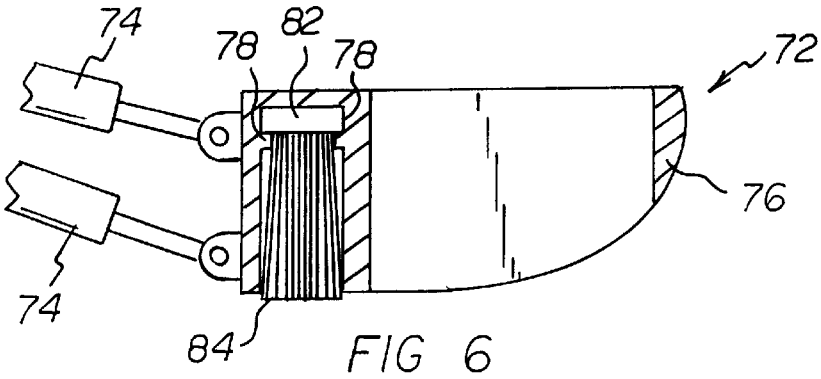
FIG. 6 is a sectional view taken along line 6—6 of FIG. 4.

FIG. 6 illustrates the preferred embodiment of the rear brush 72. As with the forward trap 42, the brush 72 is mounted to the rear extent 24 of the tractor by way of hydraulic booms 74. Specifically, a set of four booms 74 allows the brush 72 to be selectively elevated and lowered. The booms 74 further enable the brush 72 to be pivoted relative to the vehicle body 20. As with the forward booms 44, the rearward booms 74 are powered by a source of pressurized hydraulic fluid delivered via hydraulic lines (not illustrated). With continuing reference to FIG. 6, the relationship between the brush 72 and its associated bristle segment 82 is depicted. Specifically, the rear brush 72 includes two sides 76 which are angled. Additionally, the rear brush 72 includes a central stock 78 formed from elongated edges. This stock 78 is for use in supporting the bristle segment 82. In the preferred embodiment, with the bristle segment 82 secured to the stock 78, a plurality of bristles 84 extend downwardly, slightly below the lower peripheral extent of the sides 76.

An alternative brush arrangement 86 is illustrated in FIG. 10. Unlike the brush 72 of the primary embodiment, this brush 86 is powered for rotary movement. More specifically, hydraulic fluid is employed in powering a motor which, in turn, imparts rotary motion to the hydraulic brush 88. The hydraulic fluid is supplied by a hydraulic line 92 interconnecting the body 20 of the tractor and body of the rotary brush 86. The powered brush 86 allows floor contained contaminates to be agitated and placed into a slurry. Furthermore, the hydraulic brush 86 is preferably secured to the rearward extent 24 of the tractor through a pivot joint. The pivot joint functions to allow the brush 86 to reach and clean areas outside the path of the vehicle.

FIG. 9 illustrates the forward most portion of the cleaning apparatus 10 with the forward booms 44 and trap 42 removed for clarity. In the preferred embodiment, a forward windshield 94 is included to protect the driver. Additionally, a rearward canopy 96 can also be included. FIG. 9 further illustrates a pair of video cameras 98 for use in recording the areas around the apparatus 10. High intensity lamps 102 can also be included for use in lighting the areas to be video taped. The video cameras 98 enable the operator, through controls within the cockpit 32, to record the results of a cleaning operation, or the area to be cleaned.

Method of Removing Contaminates from a Sewer Pipe

The present invention also relates to the method in which the above described cleaning apparatus is employed in cleaning a sewer pipe. The method contemplated includes five steps.

First, a low-profile tractor is provided. This low-profile tractor includes a forward sediment trap and a rearward sediment brush.

Second, the tractor is driven into a sewer pipe with the trap and brush elevated. The trap and brush are so elevated such that they do not come in contact with the surface of the pipe. After the segment to be cleaned has been traversed, the tractor is brought to a stop.

Next, both the trap and the brush are lowered such that they come into contact with the floor of the pipe as well as any sediment or contaminates that are on the ground within the pipe.

Thereafter, the tractor is driven in a rearward direction. The rearward travel is done with the trap and brush in contact with the ground. In this manner, the brush first engages any sediment and lifts it from the surface such that any particulate matter is caught up in a liquid slurry.

The continued rearward travel of the tractor causes the liquid slurry created by the brush to be caught up in the trap. More specifically, the slurry accumulates within the inner periphery of the trap.

Finally, the continued rearward direction of the tractor causes all the slurry contained within the trap to be withdrawn from the interior of the pipe. The tractor can be driven to a location for deposit of the slurry material. Lifting up the boom causes the trap to be raised and the contained slurry to be deposited.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A low profile tractor for use in cleaning out drainage pipes comprising:

a watertight body having a front end and a rear end, a diesel motor positioned within the rear end, four axle motors positioned upon two axles for use in driving four wheels, energy transfer means for transferring power from the diesel motor to the axle motors;

a front trap being mounted on the front end of the body by way of hydraulic booms, the trap having four sides, an upper peripheral edge and a lower peripheral edge, the upper peripheral edge of either side of the front trap having a series of teeth, such teeth functioning to apply pressure to the top of a drainage pipe in order to wedge the body out of tight situations, the lower peripheral edge being rounded and angled approximate its inner portion, a front blade extending across the interior of the trap, the trap by way of the hydraulic booms adapted to be lifted up and folded back on top of the body of the tractor;

a rear brush being mounted to the rear end of the body by way of hydraulic booms, the rear brush having two sides which are angled and a central stock, for use in supporting a plurality of peripherals which extend downwardly below the lower peripheral extent of the sides.

2. A low profile tractor for use in cleaning out drainage pipes comprising:

a watertight body having a front end and a rear end, a diesel motor positioned within the rear end, four axle motors positioned upon two axles for use in driving four wheels, energy transfer means for transferring power from the diesel motor to the axle motors;

a front trap being mounted on the front end of the body by way of hydraulic booms, the trap having four sides, an upper peripheral edge and a lower peripheral edge, the upper peripheral edge of either side of the front trap having a series of teeth, such teeth functioning to apply pressure to the top of a drainage pipe in order to wedge the body out of tight situations, the lower peripheral edge being rounded and angled approximate its inner portion, a front blade extending across the interior of the trap, the trap by way of the hydraulic booms adapted to be lifted up and folded back on top of the body of the tractor; and a rotary hydraulic brush secured to the rear end of the body by way of a pivot joint, a hydraulic line interconnecting the body of the tractor and the rotary brush such that rotary hydraulic motion can be imparted to the brush by way of hydraulic fluid pressure.

* * * * *